US005476184A

United States Patent [19]

Hill

[11] Patent Number: 5,476,184

[45] Date of Patent: Dec. 19, 1995

[54] INSERT FOR SOFT-SIDED DUFFEL BAG

[76] Inventor: Richard Hill, 11556 Woodbridge Blvd., Seiminole, Fla. 34642

[21] Appl. No.: 214,110

[22] Filed: Mar. 17, 1994

[51] Int. Cl.[6] ..... B65D 33/02

[52] U.S. Cl. ..... 220/9.2; 190/107; 383/127

[58] Field of Search ..... 220/9.2, 9.3; 383/127; 190/107

[56] References Cited

U.S. PATENT DOCUMENTS 1,028,168 6/1912 Williams .
1,428,098 9/1922 James .
2,115,308 4/1938 Koch ..... 220/9.2
2,755,896 7/1956 Breglin .
2,806,563 9/1957 Einhorn .
4,210,186 7/1980 Belenson .
5,350,241 9/1994 Zoland ..... 383/127

*Primary Examiner*—Stephen P. Garbe
*Attorney, Agent, or Firm*—Watson, Cole, Grindle & Watson

[57] ABSTRACT

A duffel bag including an insert which comprises a rigid base upon which are pivotally supported a pair of struts which can be raised into generally vertical operative positions for supporting the side walls of the bag to prevent them from collapsing. Detents are provided for holding the struts in operative position. The struts are movable into generally horizontal, inoperative positions in which they have been folded down to positions adjacent the base.

10 Claims, 2 Drawing Sheets

INSERT FOR SOFT-SIDED DUFFEL BAG

BACKGROUND OF THE INVENTION

In recent years, soft-sided luggage has gained popularity and is in many cases replacing traditional hard-sided luggage. The light weight and lower cost of such soft-sided luggage have contributed to this popularity, and one of the most common types of such luggage is the duffel bag. The duffel bag is capable of being collapsed when not in use thereby minimizing the amount of storage space required. In addition, the soft sides of the duffel bag enable it to be readily manipulated to change the shape thereof and squeeze the duffel bag into tight confined spaces.

One of the most popular sizes of duffel bags is the larger so-called official olympic size of about 26 inches in length, 13 inches in height and 13 inches in width, which provides the same cubic area of a large 27 inch hard-sided piece of luggage. A drawback of all duffel bags, and especially the larger duffel bags, is the fact that the soft sides of the bag continually cave in when a person is trying to pack articles into the bag or remove articles from the bag. This is due to the fact that there is no support for the side walls of the bag. This is very frustrating and in many cases leads to "stuffing" articles into the duffel bag rather than neatly packing them into place. The collapsing side walls of such a bag inhibit orderly packing or unpacking since one hand must be used to hold the bag open, and a person can only use one hand to manipulate the articles. When one wants to remove an article that is not on top, he usually messes up the orderly arrangement of other articles as the desired article is pulled free.

It is a particular objective of the present invention to effectively solve the problem of collapsing soft side walls of a duffel bag by providing means for supporting the side walls in position when desired, while at the same time retaining the ability of the duffel bag to be deformed so as to be squeezed into irregular shaped areas.

SUMMARY OF THE INVENTION

The present invention comprises an insert which is adapted, to be inserted within an outer duffel bag shell which may be of conventional construction. The invention includes a rigid base upon which are pivotally supported a pair of struts of such configuration so that when the struts are raised into a generally vertical operative position they will support the side walls of the duffel bag so that they will not collapse during packing and unpacking operations. Detent means is provided for holding the struts in this operative position. The struts may also be moved into a generally horizontal inoperative position wherein the struts are folded down to a position adjacent the base.

The invention construction thereby provides great versatility since the outer duffel bag shell may be used just as a conventional duffel bag when the insert is not present. When it is desired to use the insert, the insert may be slid into the shell through an access opening in the top thereof to rest upon the bottom portion of the shell. Of course, the insert may also be readily removed if it is desired to clean or wash the outer shell. When the struts are folded down to a position adjacent the base, the structure can be used as a conventional duffel bag. On the other hand, if the struts are moved into the upright operative position, the soft side walls of the shell will be supported in position to facilitate packing and unpacking operations, thereby enabling these operations to be carried out in a neat manner just as is the case with hard-sided luggage.

The struts of the invention are formed of spring tempered wire so that when in the upright supporting position, they can be readily deformed and in fact can be drastically distorted and still automatically return to their original shape and position. This enables the duffel bag to be squeezed into a restrictive space such as when a large amount of luggage is placed into the trunk of a car, and yet when the pressure which causes the struts to be distorted is removed, the duffel bag will automatically be restored to its original shape and the soft sides of the bag will be supported for unpacking.

The invention employs a very simple construction in the form of a base and a pair of struts pivotally supported by the base, along with detent means for holding the struts in their upright operative position. These components can be manufactured in an economical manner and provide a rugged structure which can withstand the rough use and abuse that is encountered in the normal use of duffel bags.

DESCRIPTION OF THE PREFERRED EMBODIMENT

Figure 1:
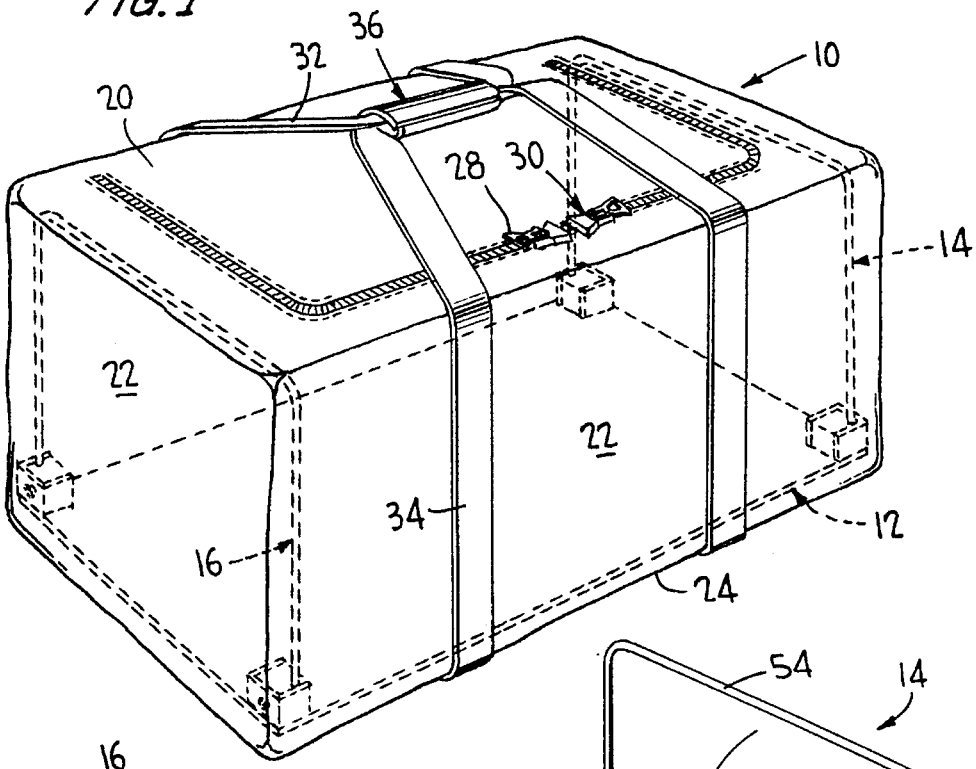
FIG. 1 is a top perspective view of a duffel bag according to the invention.

Referring now to the drawings wherein like reference characters designate corresponding parts throughout the several views, there is shown in FIG. 1 a duffel bag with the insert mounted therein and with the struts of the insert disposed in raised supporting position. The bag includes an outer duffel bag shell 10. The insert includes a base 12 and a pair of struts 14 and 16 pivotally supported at opposite ends of the base. With the insert in erected position as shown, the shell is stretched over the struts to define a top 20, four sides 22 and a bottom 24. The top of the shell is provided with a pair of zippers 28 and 30 to provide a three-sided closable access opening at the top of the bag. A pair of handles 32 and 34 formed of suitable fabric are secured to the bottom and the sides of the shell as by stitching and can be connected to one another as shown at 36 by a conventional VELCRO overlay. One handle has an area of VELCRO thereon, and a flap is secured to the handle. This flap has another area of VELCRO thereon, and the flap can be folded around the other handle with the two areas of VELCRO engaging one another.

Figure 2:
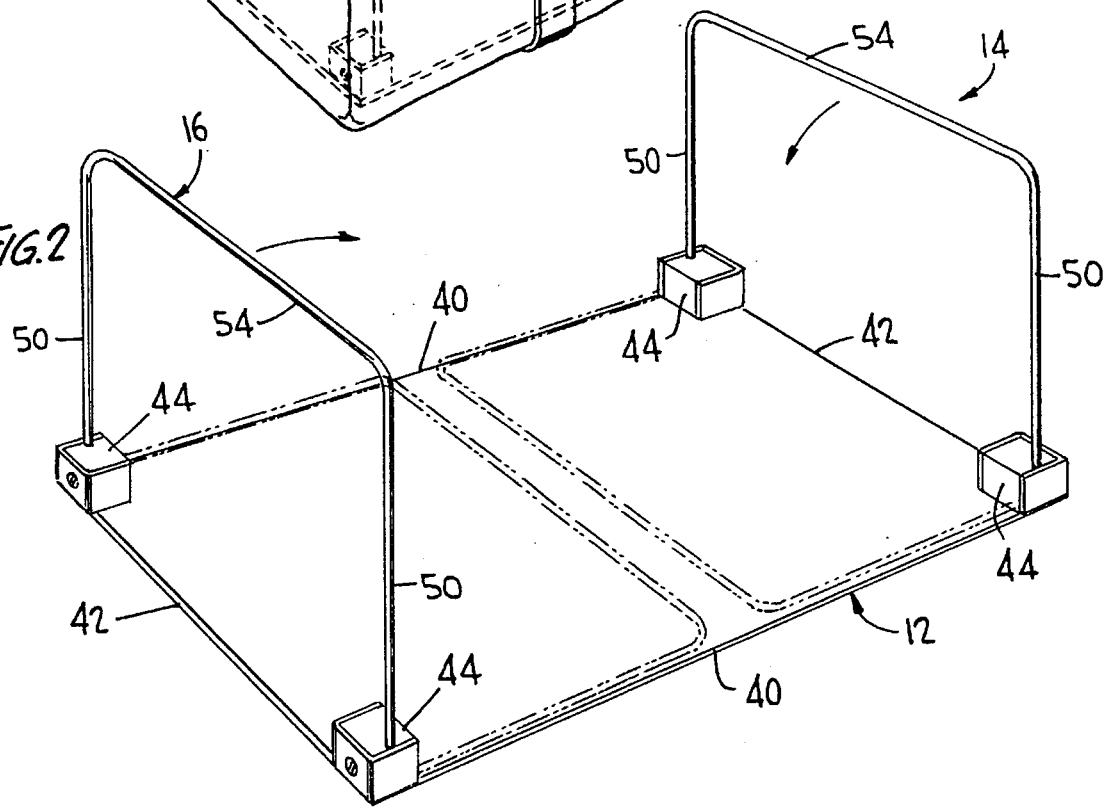
FIG. 2 is a top perspective view of the insert of the invention.
Figure 3:
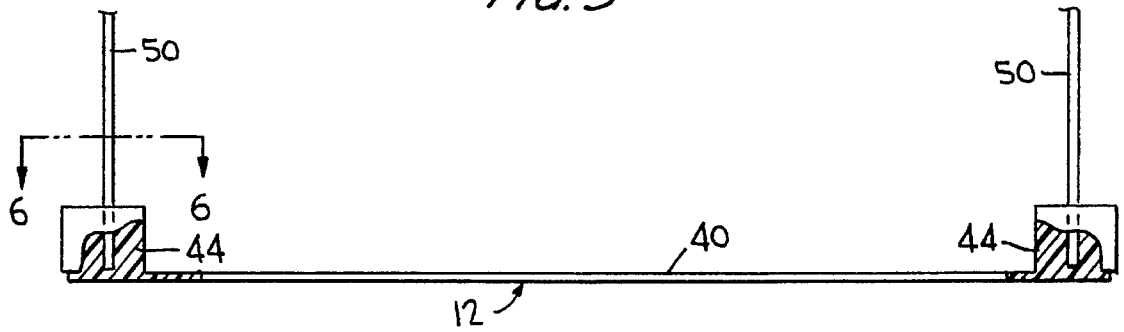
FIG. 3 is side view of the insert, partly broken away.
Figure 4:
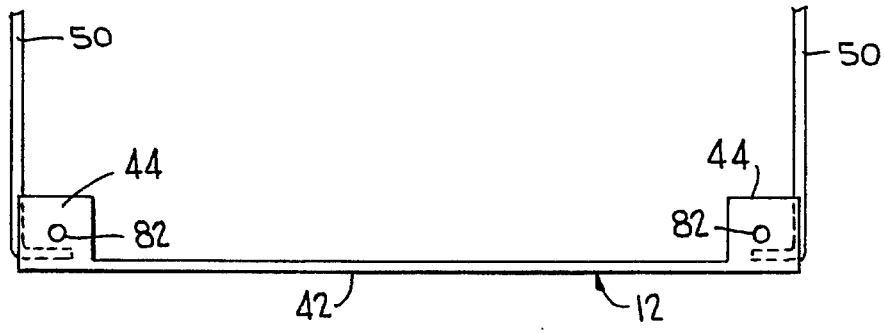
FIG. 4 is an end view of the insert with the retaining means of the detent mechanism removed.

Referring to FIG. 2, base 22 is comprises a rigid one-piece molded member of a suitable plastic material having long side edges 40 and shorter end edges 42 dimensioned so as to fit snugly within the duffel bag when the insert is supported on the bottom of the bag. The base is accordingly rectangular and has four corners each of which includes an integral upstanding boss 44 to provide four bosses of similar construction. The struts 14 and 16 are adapted to be moved between the generally horizontal folded position adjacent the upper surface of the base as shown in phantom lines to the full line position wherein the struts are disposed in raised generally vertical position to support the side walls of a surrounding duffel bag shell.

The two struts are of similar construction, and each of the struts includes a pair of spaced arms 50 which are joined at their upper ends by a bight potion 54 extending at generally right angles to the arms to define U-shaped struts. The lower ends of arms 50 are provided with fingers 56 which extend laterally thereof at generally right angles thereto and which serve to pivotally mount the struts on the associated bosses 44. The struts are formed of spring tempered wire which can be drastically deformed and still automatically return to its original shape. The struts may be formed of one-eighth inch diameter spring tempered steel wire.

Figure 5:
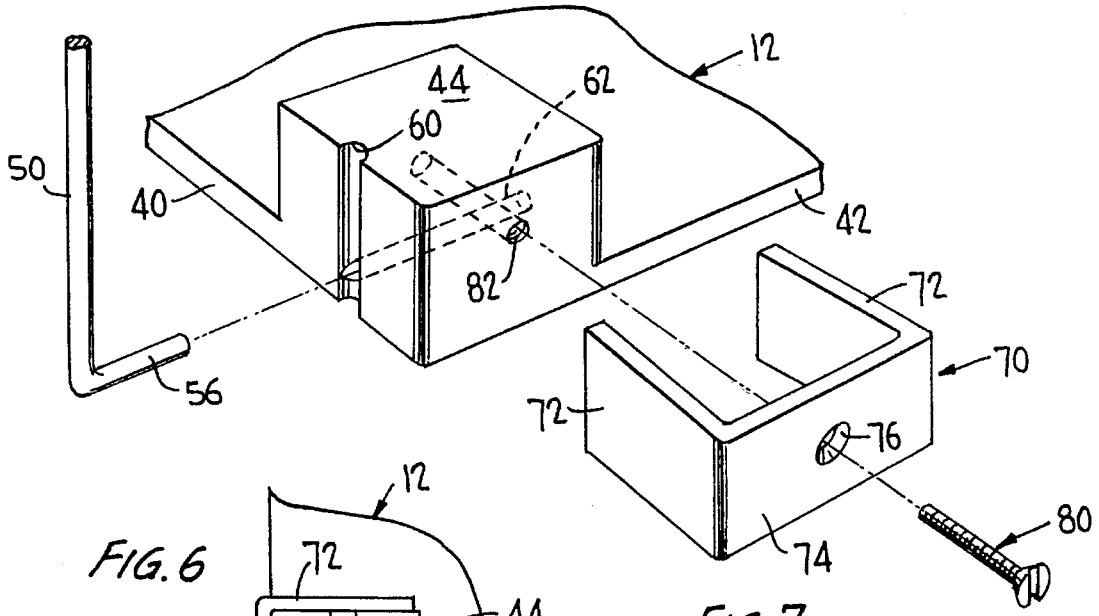
FIG. 5 is a top perspective exploded view of the components at one corner of the base.
Figure 6:
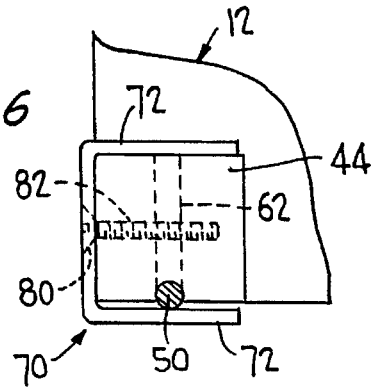
FIG. 6 is a top view of the assembled components at one corner of the base.
Figure 7:
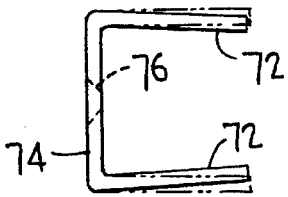
FIG. 7 is a top view, of the retaining means of the invention.

Referring to FIGS. 5–7, each of bosses 44 has a recess 60 molded therein and extending in a generally vertical direction. Recess 60 has semi-circular cross-section of a dimension so as to snugly receive approximately one-half of an associated arm 50 therein to serve as a detent means for retaining the arms of the strut in the raised operative position. A through hole 62 extends through the boss and is formed during the molding of the base. The holes 62 form a pivot hole which receives the fingers 56 of the struts so that the struts are thereby pivotally supported on the bosses of the base.

When the struts are in the raised operative position, the arms of the struts are retained in the recesses 60 by means of four retaining means 70 each of which is mounted on one of bosses 44. The retaining means is a generally U-shaped spring tempered steel member including a pair of legs 72 connected by a bight portion 74. The arms 76 are spaced from one another and receive a boss 44 and a strut arm therebetween as shown in FIG. 6. The bight portion 74 has a tapered hole 76 formed therethrough which is adapted to receive a flathead screw 80 which is threaded into a tapped hole 82 formed in boss 44. Hole 82 extends at right angles to hole 82 and is disposed vertically thereabove so that the holes do not intersect one another.

The retaining means 72 is formed as shown in full lines in FIG. 7 so that the arms are initially disposed in the full line position. The corners between the bight portion 74 and the arms 72 have been overbent beyond 90 degrees and can expand into the phantom line position when the remaining means is mounted on the boss. This provides a significant resilient biasing force which pushes an adjacent arm 50 into the associated recess on a boss to thereby retain the struts in the raised operative position. When it is desired to pivot the struts into the horizontal inoperative position, the struts may be manually grasped and rotated about the fingers 56 whereupon the arms 50 of the struts will move out of the recesses 60 and the arms can be moved into a substantially horizontal position adjacent the top surface of the base.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. An insert for a soft-sided duffel bag comprising, a rigid base adapted to rest on the inner bottom of a soft-sided duffel bag, a pair of struts movable between a lowered generally horizontal position and a raised generally vertical position for preventing the side walls of a soft-sided duffel bag from collapsing, each of said struts including a pair of spaced arms having upper and lower ends, the upper ends; of the arms of each strut being connected by a bight portion, the lower ends of each of said struts being pivotally supported on said rigid base, said struts being formed of spring tempered wire so that they may be readily deformed to a great degree and will always return to their original shape, and detent means on said base for holding said struts in said raised position, said base including a plurality of spaced integral upstanding bosses, each of the lower ends of the struts being pivotally supported by one of said bosses.

2. An insert as defined in claim 1 wherein each of said bosses has a pivot hole formed therein, each lower end of said struts including a finger extending therefrom and disposed within said pivot hole.

3. An insert as defined in claim 2 wherein said detent means includes a recess formed in each of said bosses for receiving a portion of an associated strut arm of a strut, and retaining means for retaining each of said portions of a strut arm within an associated recess.

4. An insert as defined in claim 3 wherein said recess extends generally in a vertical direction.

5. An insert as defined in claim 3 wherein each of said pivot holes opens into the recess of an associated boss.

6. An insert as defined in claim 3 wherein each of said bosses has an additional hole formed therein, said retaining means comprising a generally U-shaped member fitting around each of said bosses, and mounting means extending into each of said additional holes to mount each retaining means on an associated boss.

7. An insert as defined in claim 6 wherein each of said retaining means is formed of resilient material so as to resiliently bias an adjacent strut arm into the recess of an associated boss.

8. An insert for a soft-sided duffel bag comprising, a rigid base adapted to rest on the inner bottom of a soft-sided duffel bag, said base comprising a one-piece molded member having corners, an integral upstanding boss being formed at said corners, a pair of struts movable between a lowered generally horizontal position and a raised generally vertical position for preventing the side walls of a soft-sided duffel bag from collapsing, each of said struts including a pair of spaced arms having upper and lower ends, the upper ends of the arms of each strut being connected by a bight portion, each lower end of said struts including a finger extending laterally therefrom and being pivotally supported by one of said bosses, said struts being formed of spring tempered wire so that they may be readily deformed to a great degree and will always return to their original shape, and detent means on said base for holding said struts in said raised position, said detent means including a recess formed in each boss for receiving a portion of one of said strut arms, and resilient means on each of said bosses for biasing said portion of one of said strut arms into the recess of an associated boss.

9. In combination, an outer duffel bag shell having formed of soft material, said shell including a top portion and a bottom portion, said top portion including a closable access opening, and an insert comprising a rigid base adapted to rest on said bottom portion of the shell, a pair of struts movable between a lowered generally horizontal position and a raised generally vertical position for preventing the said sides from collapsing, each of said struts including a pair of spaced arms having upper and lower ends, the upper ends of the arms of each strut being connected by a bight portion, the lower ends of each of said struts being pivotally supported on said rigid base, said struts being formed of spring tempered wire so that they may be readily deformed to a great degree and will always return to their original shape, and detent means on said base for holding said struts in said raised position, said base including a plurality of spaced integral upstanding bosses, each of the lower ends of the struts being pivotally supported by one of said bosses.

10. The combination as defined in claim 9 wherein said struts are disposed in said raised position, said outer shell being stretched over said struts to define sides and a top of the duffel bag.

* * * * *